US005311994A

United States Patent [19]

Oliff

[11] Patent Number: 5,311,994

[45] Date of Patent: May 17, 1994

[54] PANEL LOCKING ARRANGEMENT WITH RELEASE MEANS

[75] Inventor: James R. Oliff, Austell, Ga.

[73] Assignee: The Mead Corporation, Dayton, Ohio

[21] Appl. No.: 62,970

[22] Filed: May 18, 1993

[51] Int. Cl.[5] ..... B65D 5/42; B65D 5/54

[52] U.S. Cl. ..... 206/427; 206/158; 229/924; 229/198.2; 229/40

[58] Field of Search ..... 206/427, 158; 229/924, 229/926, 40, 198.2

[56] References Cited

U.S. PATENT DOCUMENTS

| | | | |
|---|---|---|---|
| 3,128,010 | 4/1964 | Forrer | 206/155 |
| 4,382,511 | 5/1983 | Hamelin et al. | 229/924 |
| 4,437,606 | 3/1984 | Graser | 229/40 |
| 4,681,217 | 7/1987 | Hernandez | 206/427 X |
| 4,685,566 | 8/1987 | Wilson | 206/427 |
| 4,708,284 | 11/1987 | Sutherland et al. | 206/427 |

FOREIGN PATENT DOCUMENTS

| | | | |
|---|---|---|---|
| 2248604 | 4/1992 | United Kingdom | 206/427 |

*Primary Examiner*—William I. Price
*Attorney, Agent, or Firm*—Thomas A. Boshinski

[57] ABSTRACT

A locking arrangement for interlocking two or more overlapped panels includes an outer panel having a locking tab at least partially covering a first aperture, the locking tab being connected at a base to the outer panel along a foldable portion. An inner panel has a retention tab at least partially covering a retention aperture, the retention tab being connected at a base to the inner panel along a foldable portion. The inner and outer panels are overlapped so that the locking and retention tabs are substantially overlapped with the foldable portions thereof in opposed relationship whereby the locking tab may be driven through the first aperture and the retention aperture to displace the retention tab into a mutually locked and braced position. The locking tab may be released from the locked and braced relationship by a pull tab struck from both the locking tab and the outer panel, the pull tab being connected to the locking tab and extending into the outer panel through the foldable portion.

3 Claims, 7 Drawing Sheets

PANEL LOCKING ARRANGEMENT WITH RELEASE MEANS

BACKGROUND OF THE INVENTION

The present invention relates to an arrangement for interlocking a two or more overlapped paperboard panels, such as is done in connection with paperboard cartons for packaging. More particularly, the invention relates to such an arrangement which includes means for releasing the locking arrangement when it is desired to remove the packaged product or products from the carton.

Locking arrangements for use in connection with paperboard cartons are well known. A simple punch-type lock can be seen by reference to U.S. Pat. No. 3,128,010. A locking tab is foldably connected to a first panel, while a second, underlying panel includes an aperture covered by a retention tab which is aligned with the tab. The tab is driven through the aperture to secure the panels together. An important consideration for locking devices of this type is retention of the locking tab in position. As can be readily recognized, it is important that the locking tab not be released when the carton is in use for carrying product. Many arrangements for securing the locking tab into its locked position are well known in the art.

A further example of a retention tab may be seen by reference to U.S. patent application Ser. No. 08/060,866. There, a top-gripping carrier for bottles is shown on which the bottles are secured by positioning of the bottle necks in apertures formed in upper and lower panels of the carrier. The bottle-receiving apertures are formed of a generally keyhole shape so that sliding movement of the upper and lower panels with respect to each other secures the bottles. The panels are in turn fixed into their relative positions by a punch-lock arrangement wherein a locking tab is driven into a receiving aperture.

It may be difficult or awkward for the purchaser of such a package to remove the bottles from the carrier for use. One possibility is to release the locking tabs and move the panels with respect to each other in a reverse operation of the packaging of the product. However, the locking tabs are designed not to be easily released to avoid unwanted opening of the package. The tabs are located in a relatively crowded portion of the package, being positioned near the bottle necks and several overlapped paperboard panels, making manipulation of the tabs difficult. Further, it is not immediately obvious to the user how the operation may be performed. A second alternative is to simply tear the carton, although the several layers of paperboard in close proximity to each other make even this approach difficult.

It is known to provide perforated tear strips in the walls of a paperboard carton to simplify release of the packaged product. However, this may reduce the strength of the carrier and assures that the carrier cannot be reused, for example, to carry empty bottles back to the point of purchase for recycling and/or refund.

What is needed, therefore, is an improved release means for use with locking arrangements for paperboard cartons. Such a means should be relatively easy to use and understand, but should not detract from the performance or appearance of the carton.

SUMMARY OF THE INVENTION

In meeting the foregoing need, the present invention provides a locking arrangement for interlocking two or more overlapped panels. An outer panel has defined therein a locking tab at least partially covering a first aperture, with the locking tab being connected at a base to said outer panel along a foldable portion. An inner panel has defined therein a retention tab at least partially covering a retention aperture, with the retention tab being connected at a base to the inner panel along a foldable portion. The inner and outer panels are overlapped so that locking and retention tabs are substantially overlapped with the foldable portions thereof in opposed relationship. The locking tab may then be driven through the first aperture and the retention aperture to displace the retention tab into a mutually locked and braced position. Means for facilitating release of the locking tab from the locked and braced relationship includes a pull tab struck from both the locking tab and the outer panel, with the pull tab being connected to the locking tab and extending into the outer panel through the foldable portion.

In accordance with one embodiment of the invention, the pull tab may be defined by a cut line having a first end within the locking tab and extending through the foldable portion into the outer panel and terminating at a second end within the outer panel.

According to a still further alternate embodiment, the pull tab may be defined by a cut line having a first end within the locking tab, extending through the foldable portion into the outer panel and back through the foldable portion, and terminating at a second end within the locking tab.

DETAILED DESCRIPTION OF THE PREFERRED EMBODIMENTS

In a preferred embodiment, the present invention may be used in connection with a paperboard carrier for bottles wherein the bottles are engaged by their necks. Such a carrier is described herein, and in greater detail in U.S. patent applications Ser. Nos. 07/877,792 and 08/060,866, which applications are incorporated herein by reference. However, as will be described, the present invention may be used with other types of paperboard cartons using locking arrangements for securing paperboard panels.

Figure 1:
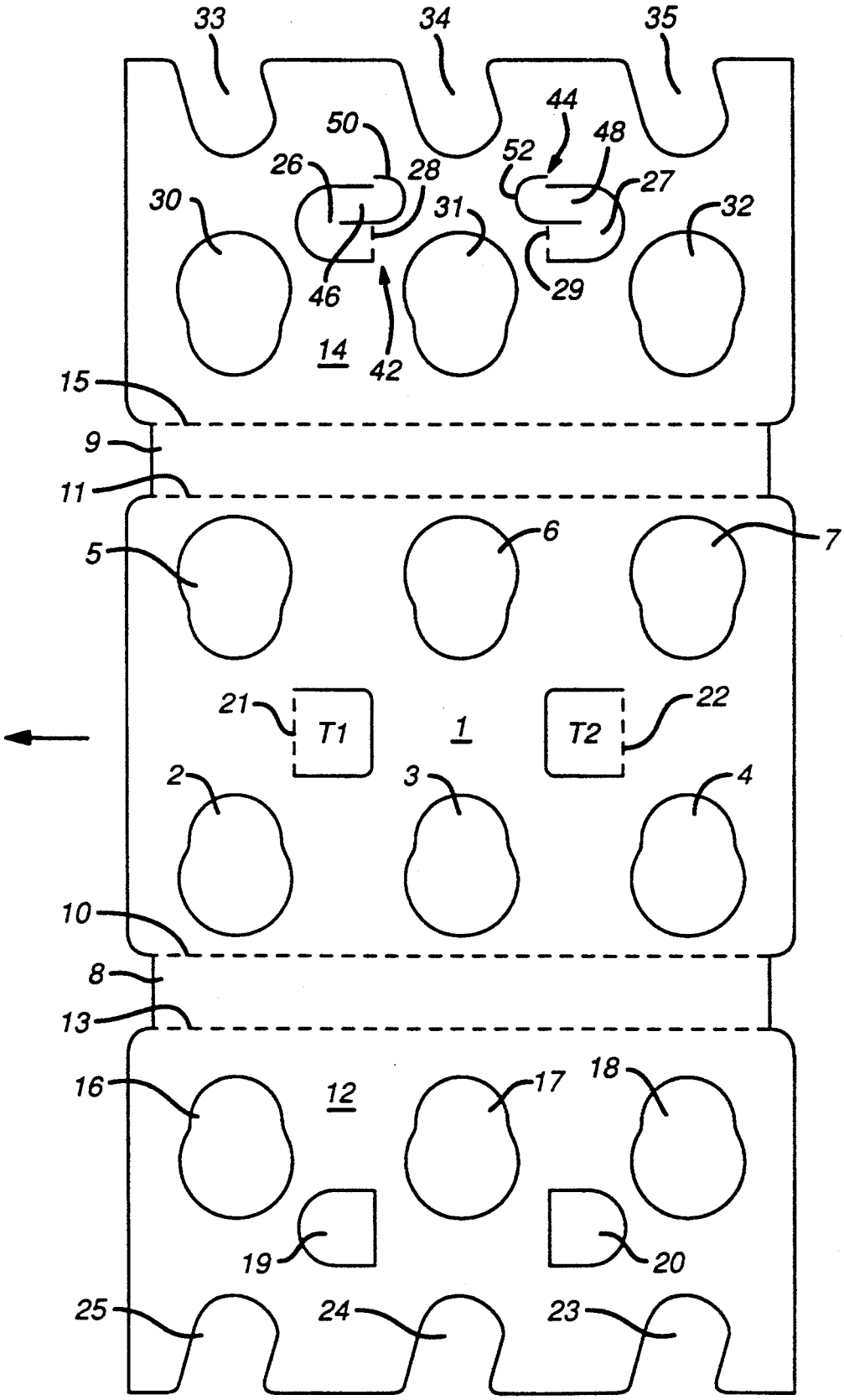
FIG. 1 is a plan view of a blank from which a carton may be formed incorporating the locking arrangement having release means in accordance with the present invention.

A unitary blank formed of paperboard is shown in FIG. 1. As viewed from the inside, the blank includes main panel 1 having keyhole apertures 2–7. Of course, the keyhole apertures include standard large and small portions. Side panels 8 and 9 are foldable joined to main panel 1 along fold lines 10 and respectively. A supplementary panel designated by the numeral 12 is foldably joined to side panel 8 along fold line 13. At the other end of the blank, supplementary panel 14 is foldably joined to side panel 9 along fold line 15. Supplementary panel 12 includes keyhole apertures 16, 17 and 18 as well as locking apertures 19 and 20. Also, retention tabs TI and T2 are struck from main panel 1 and are joined thereto, respectively, along fold lines 21 and 22.

For enveloping the necks of bottles to be packed, cutaway areas 23, 24 and 25 are formed in supplementary panel 12. At the other end of the blank, locking tabs 26 and 27 are struck from supplementary panel 14. Locking tab 26 is foldably joined to supplementary panel 14 along fold line 28 while locking tab 27 is foldably joined to supplementary panel 14 along fold line 29. Tabs 26 and 27 include release means 42 and 44 described in detail below.

Keyhole apertures 30, 31 and 32 are formed in supplementary panel 14 and cutaway areas 33, 34 and 35 are struck from supplementary panel 14 along one side edge thereof.

Figure 2:
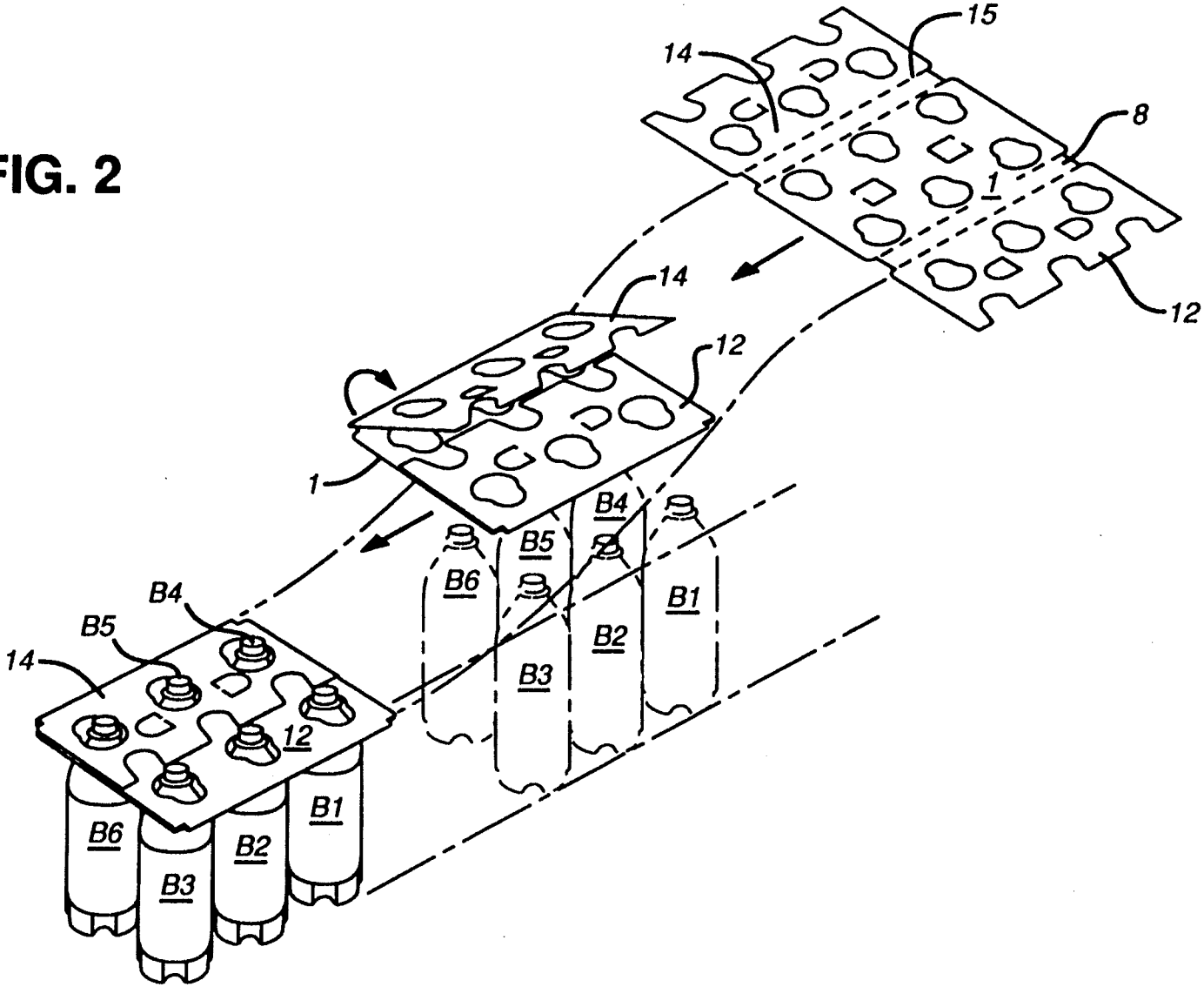
FIG. 2 is a view which shows the sequence of folding of one supplementary panel into overlapping relation with the main panel followed by folding of the other supplementary panel into overlying relation with respect to the first supplementary panel.
Figure 3:
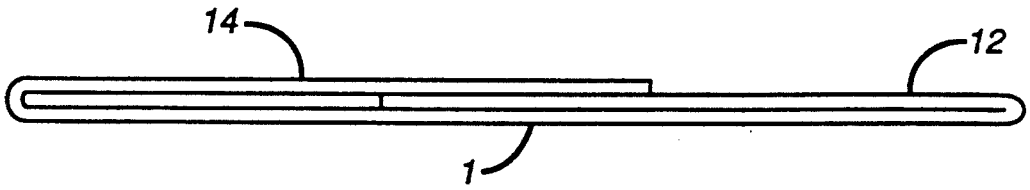
FIG. 3 shows the collapsed blank with overlapping supplementary panels as viewed from the end edges of the supplementary panels.

Initial stages of a packaging operation are indicated in FIG. 2 wherein supplementary panel 12 is elevated and folded over into flat face contacting relationship with the main panel i and side panel 8. Supplementary panel 14 is elevated and folded forwardly along fold line 15 to occupy the position shown in the left portion of FIG. 2.

The downward travel of the collapsed carrier, as also shown in FIG. 2, results in the necks of bottles B1–B6 being enveloped by the large portions of the respective keyhole apertures of main panel i and supplementary panels 12 and 14. The bottle group with it collapsed carrier is depicted in the left hand portion of FIG. 2.

Figure 4:
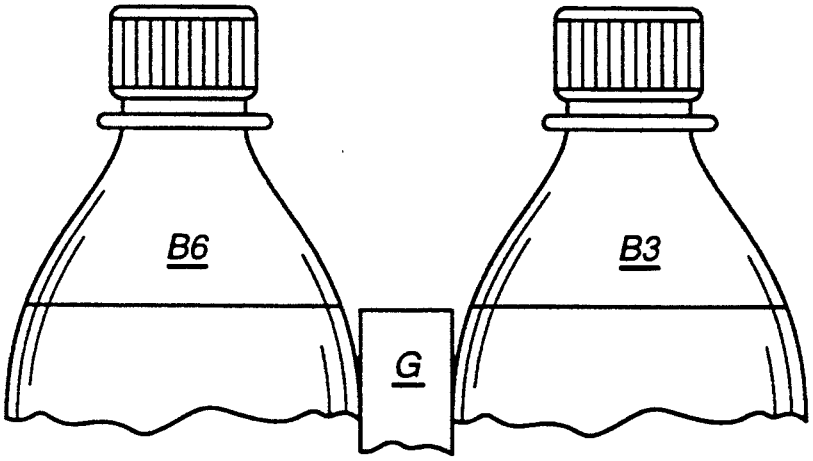
FIG. 4 shows a pair of bottles separated by a machine element as these bottles appear before a collapsed blank is lowered into position.
Figure 5:
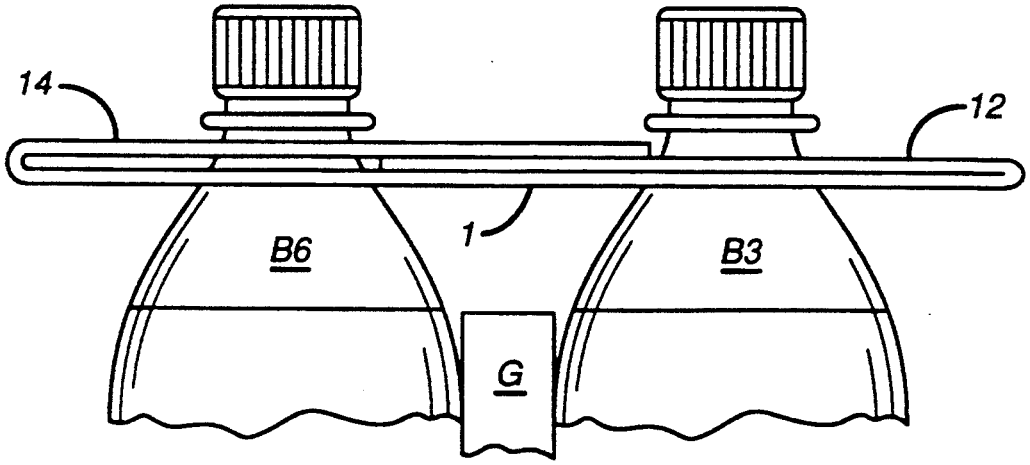
FIG. 5 is a view similar to FIG. 4 showing a pair of bottles with the collapsed blank lowered into position.

The two rows of bottles are separated, as indicated in FIG. 4, by means of machine guide G. In FIG. 5, bottles B6 and B3 are shown in conjunction with the collapsed carrier having main panel 1 and supplementary panels 12 and 14 shown in their collapsed condition.

Figure 6:
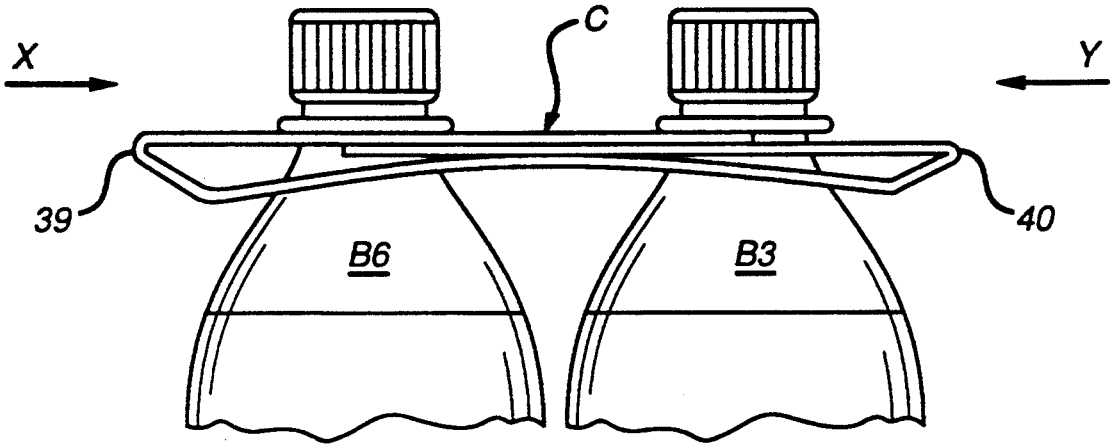
FIG. 6 is a cross-sectional view of the blank and associated pair of bottles following inward movement of the bottles into engagement with each other and which shows the locking apparatus for manipulating the locking tabs into locking relation with the locking tabs formed in one supplementary panel into the apertures formed in the other supplementary panel, such locking elements being maintained in locked condition.
Figure 7:
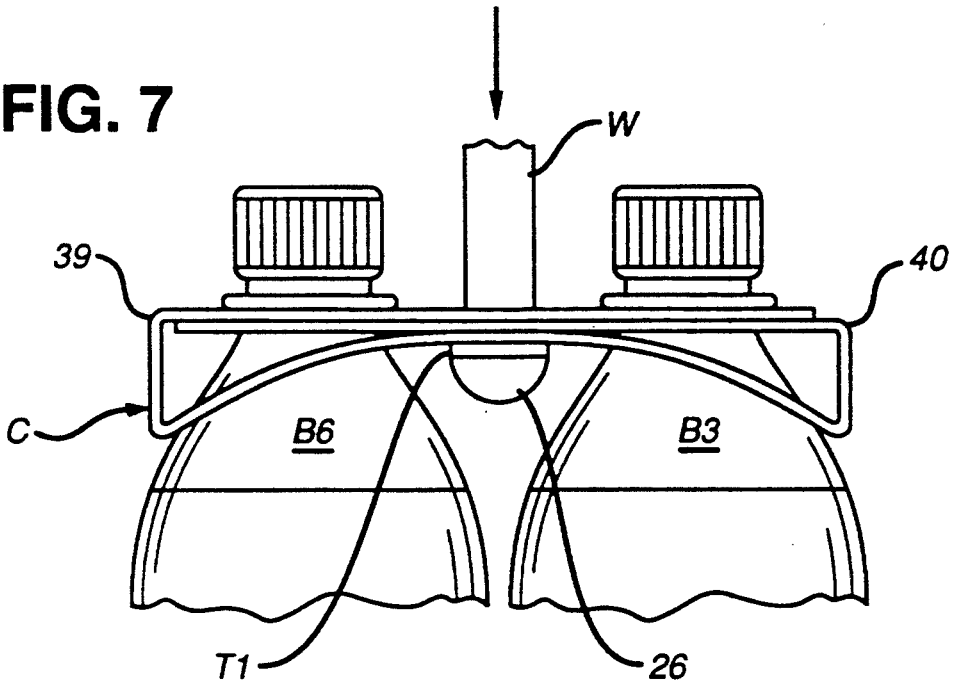
FIG. 7 shows the completely assembled structure of a pair of bottles together with the carrier structure.

In FIG. 6, the bottles B6 and B3 are shown in their final adjacent, assembled position as determined by the inward guiding action of machine guides (not shown) as represented by arrows X and Y. Corner edges 39 and 40 of the carrier C are also moved inwardly as indicated by arrows X and Y by guiding action of additional machine guides (not shown). This forces the carrier C into the position shown in FIG. 7, whereupon a locking element W operates to drive locking tabs 26 and 27 (see FIG. I) respectively through apertures 19 and 20.

The action of locking element W also activates retaining tabs T1 and T2 and causes them to prop respectively against locking tabs 26 and 27, thus to secure the carrier in set-up, latched condition. The necks of the bottles are therefore disposed in the small portions of the respective keyhole apertures and the respective cutaway areas, as a result of which, the bottles are securely locked in the carrier.

The action of the locking tabs 26 and 27 within the apertures 19 and 20 precludes the corner edges 39 and 40 of the carrier from moving away from each other, in the directions opposite to arrows X and Y. Thus, the carrier is secured throughout its use.

Figure 8:
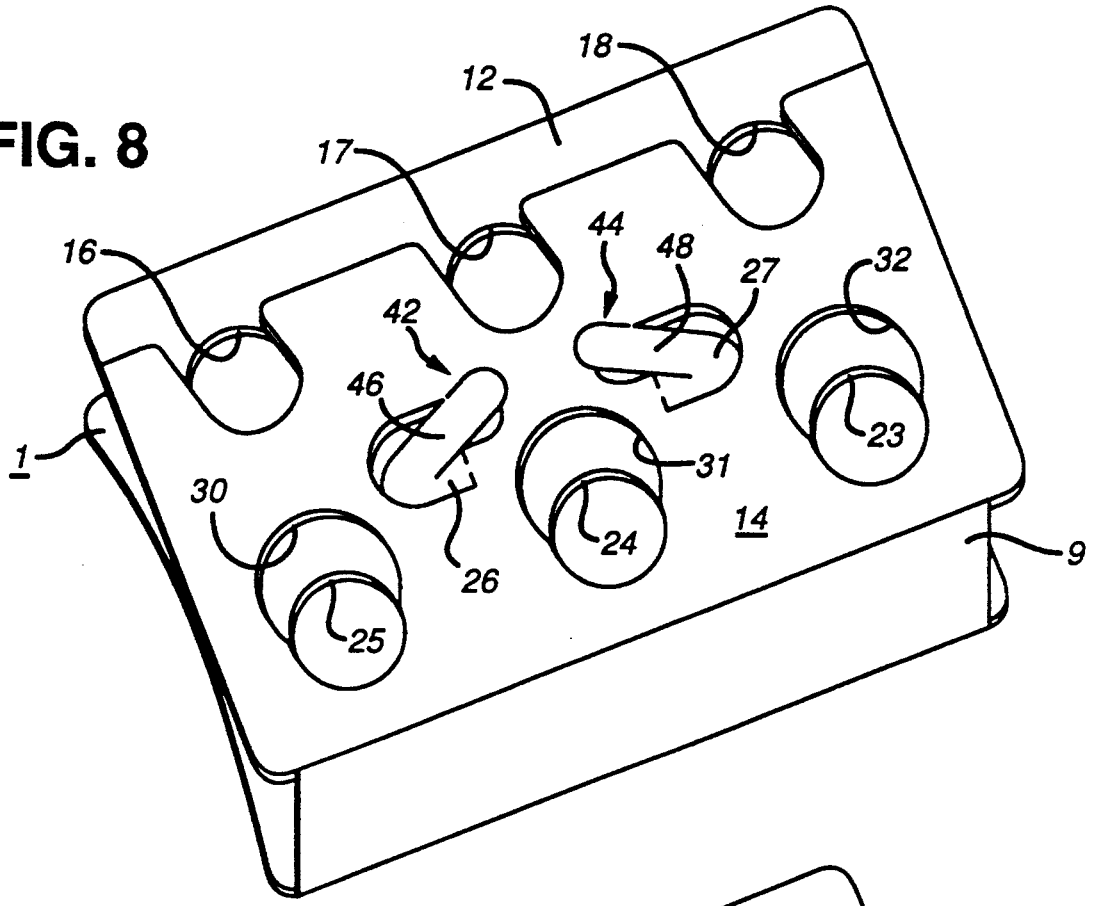
FIG. 8 is an isometric view of the carrier in fully set up and locked condition, with the packaged bottles not shown for clarity.

Referring now back to FIG. and to FIG. 8, a release means in accordance with the present invention for use in connection with locking tabs 26 and 27 can be seen generally at 42 and 44 respectively. Each release means includes a pull tab 46 and 48, which are defined by cut lines 50 and 52 respectively. In the embodiment shown in FIG. 1, it can be seen that each cut line 50 and 52 includes a first end positioned within the respective locking tab 26 and 27, and which extends through the fold line 28 and 29 respectively and into the supplementary panel 14. As shown in FIG. 8, when the locking tabs 26 and 27 are driven inwardly of the package for locking panels 12 and 14, the pull tabs 46 and 48 move upwardly and away from the surface of panel 14, where they may be readily grasped for opening of the package.

Figure 8A:
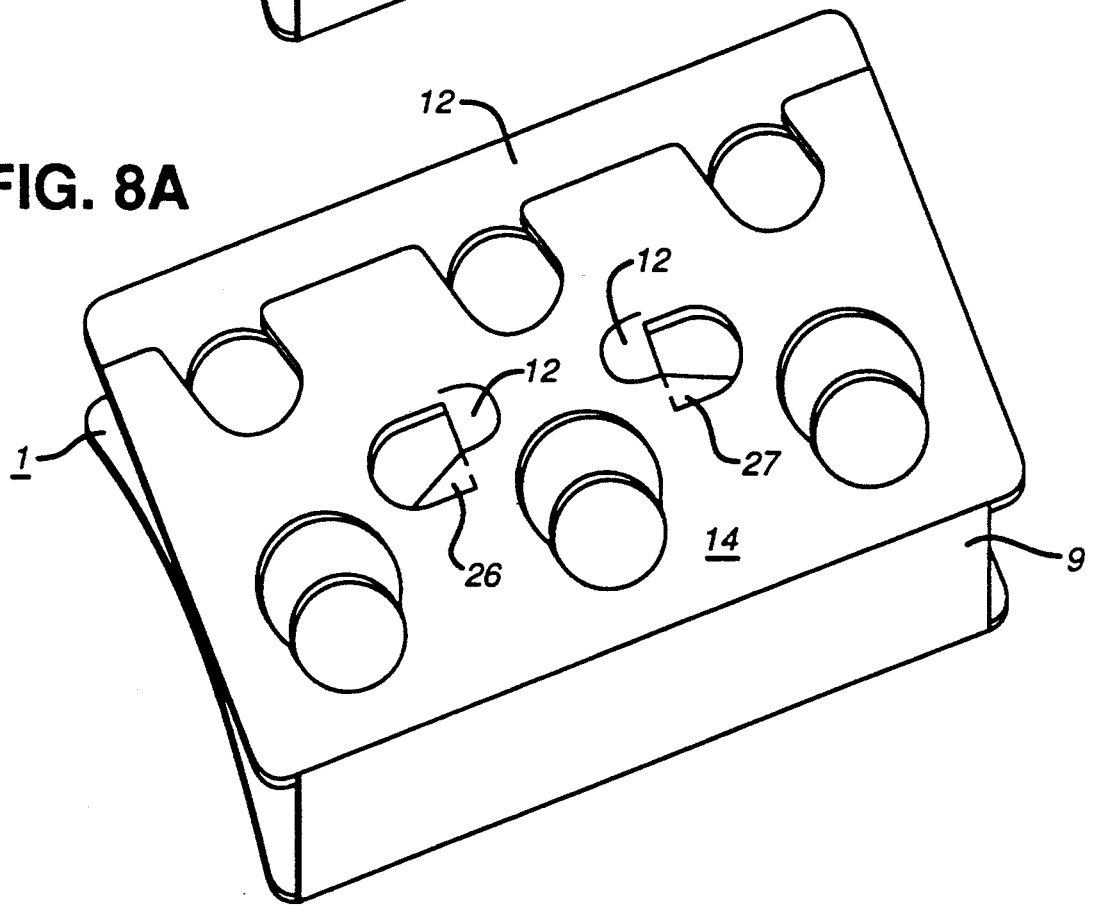
FIG. 8A is a view similar to FIG. 8 but showing the pull tabs removed to release the locking tabs for opening of the carrier.

To open the package shown in FIG. 8, the user grasps first pull tab 46 and then pull tab 48 and pulls each in the general direction of the associated locking tab 26 and 27. This action has the effect of tearing away a portion of each of the locking tabs 26 and 27, as shown in FIG. 8A. This in turn destroys the ability of the locking tabs 26 and 27 to firmly lock the panels 14 and 12 with respect to each other, thereby enabling the panels to be easily moved apart, whereafter the packaged bottles may be removed.

Notwithstanding the removal of the pull tabs, the package still retains sufficient strength, especially when lifted by placing the thumb and forefinger into the openings formed by locking tabs 26 and 27, to carry a plurality of empty bottles for return or recycling.

Referring back to FIG. I, it will be seen in the embodiment shown therein that the cut lines 50 and 52 defining the pull tabs 46 and 48 respectively terminate at a second end at a point close to, but slightly spaced from, the cut line defining the outer edge of locking tabs 26 and 27. This enables pull tabs 46 and 48 to be attached to the carton panel 14 at each side of the tabs.

Figure 9:
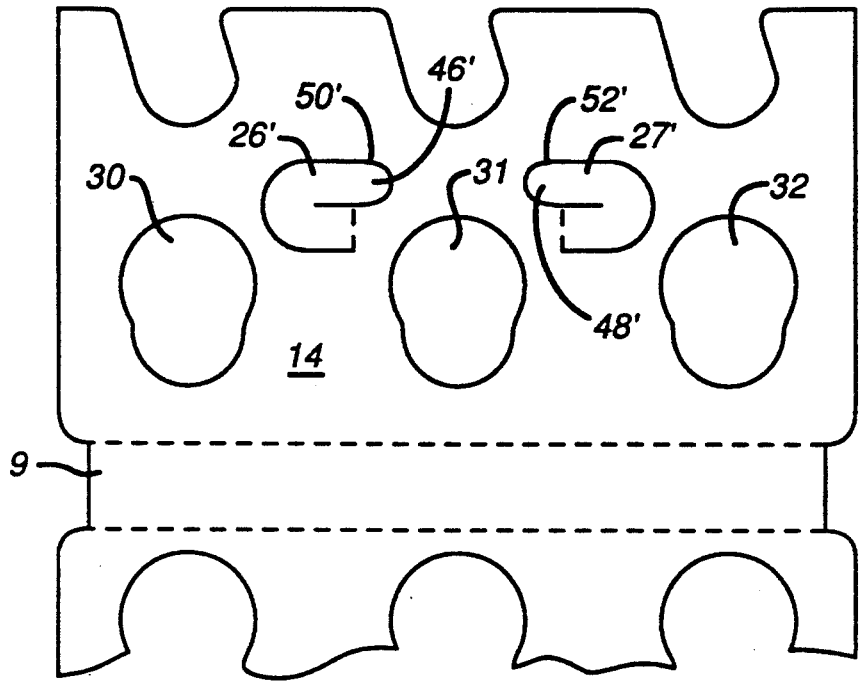
FIG. 9 is a plan view showing a portion of a blank similar to FIG. 1 with a locking arrangement having release means according to an alternate embodiment of the invention.
Figure 10:
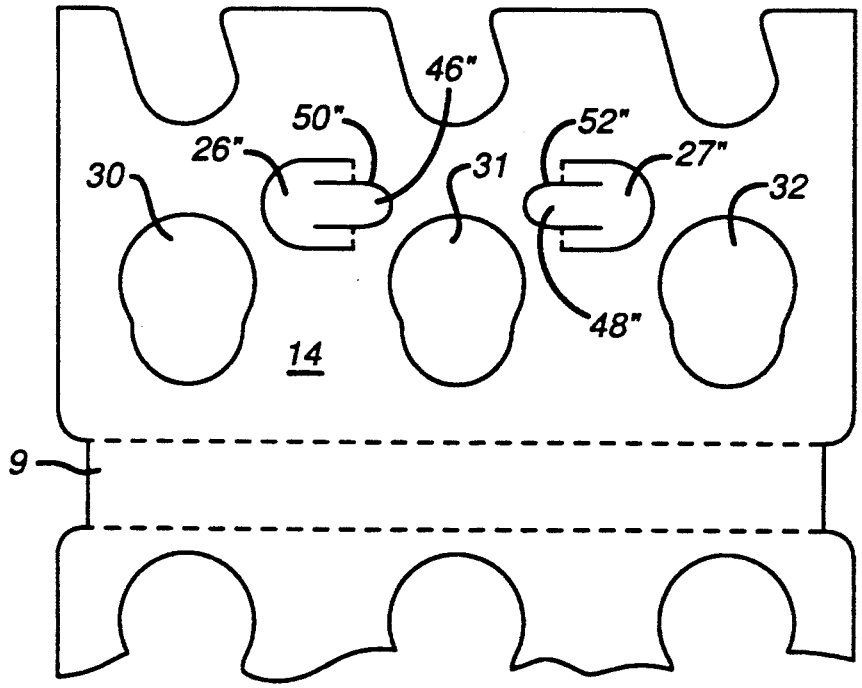
FIG. 10 is a view similar to FIG. 9 showing a further alternate embodiment of the invention.

It will be recognized that a number of alternative arrangements for the pull tabs may be used. For example, as shown in FIG. 9, cut lined 50' and 52' have their second ends lying along the cut lines which define the locking tabs 26 and 27. As a result of this construction, the resulting pull tabs 46' and 48' may be more easily torn away, but the locking tabs 26 and 27 may be of a reduced locking strength. A further alternative can be seen by reference to FIG. 10, wherein both ends of the cut lines 50" and 52" are disposed within the locking tabs 26" and 27". In this embodiment, tearing away of the pull tabs 46" and 48" tears a center strip from each locking tab 26" and 27".

Figure 11:
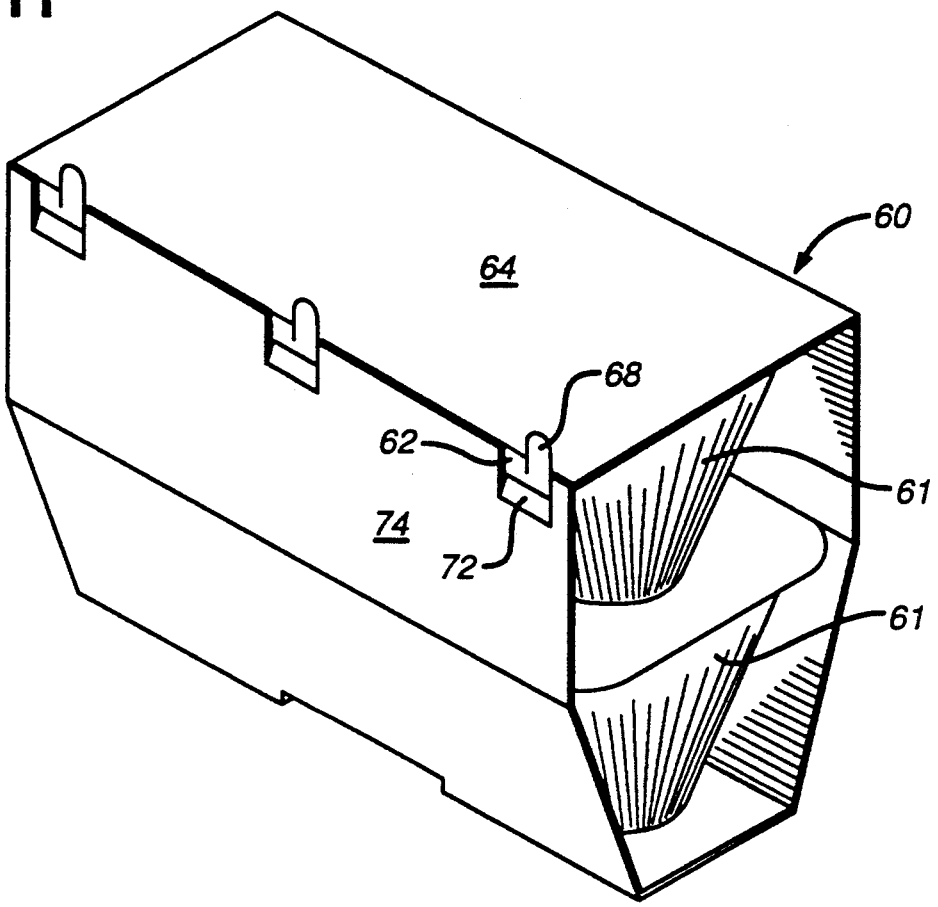
FIG. 11 is a three-quarter view of a carton for cups showing a still further alternate embodiment of the invention.
Figure 12:
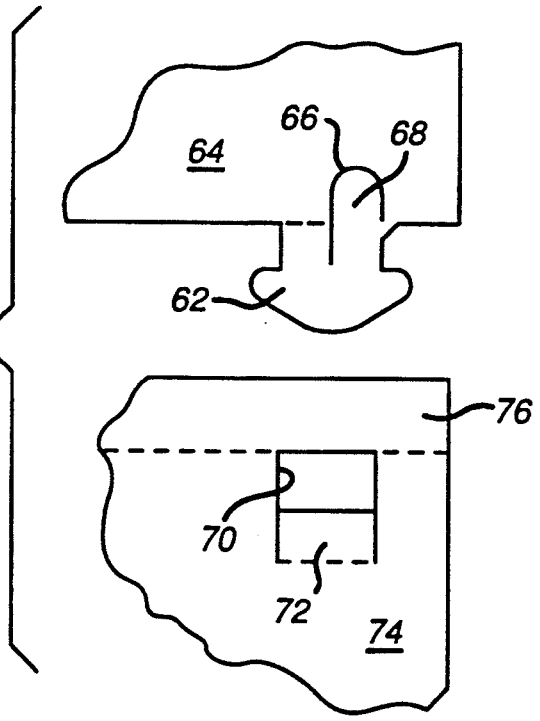
FIG. 12 is a plan view of two fragments of a blank for forming a carton as shown in FIG. 11, showing the locking arrangement used in securing the carton.

It should also be recognized that the release means for the locking tab may be used in conjunction with other styles of locked paperboard cartons. For example, referring to FIG. 11, a wraparound, locked-style carton 60 for use in connection with cups 61 of a product such as yoghurt may be seen. The portions of the blank forming one of the locks for the carton 60 may be seen by reference to FIG. 12. A locking tab 62 extends from the edge of top panel 64. A cut line 66 formed in a manner similar to that shown in FIG. I defines a pull tab 68. In the opposite blank portion, a retention aperture 70, partially covered by a retention tab 72, is formed in an upper portion of side panel 74.

To lock the carton, top panel 64 is positioned over lap panel 76, and locking tab 62 is located over retention aperture 70. Thereafter, the locking tab 62 is driven into the aperture 70 to secure the carton. To open the carton, the pull tab 68 is pulled downwardly, thereby tearing away a portion of the locking tab 62. The lock may be easily released, and upon removing pull tabs for each of the locking tabs used along the upper edge of the carton, the carton may be easily opened.

What is claimed is:

1. A locking arrangement for interlocking two or more overlapped panels, comprising:

an outer panel having defined therein a locking tab at least partially covering a first aperture, said locking tab being connected at a base to said outer panel along a foldable portion;

an inner panel having defined therein a retention tab at least partially covering a retention aperture, said retention tab being connected at a base to said inner panel along a foldable portion;

said inner and said outer panels being overlapped so that said locking and retention tabs are substantially overlapped with the foldable portions thereof in opposed relationship whereby said locking tab may be driven through said first aperture and said retention aperture to displace said retention tab into a mutually locked and braced position;

means for facilitating release of said locking tab from said locked and braced relationship including a pull tab struck from both said locking tab and said outer panel, said pull tab being connected to said locking tab and extending into said outer panel through said foldable portion.

2. The locking arrangement defined in claim 1 wherein said pull tab is defined by a cut line having a first end within said locking tab and extending through said foldable portion into said outer panel and terminating at a second end within said outer panel.

3. The locking arrangement defined in claim 1 wherein said pull tab is defined by a cut line having a first end within said locking tab, extending through said foldable portion into said outer panel and back through said foldable portion, and terminating at a second end within said locking tab.

* * * * *